United States Patent [19]

Hall

[11] Patent Number: 4,674,248

[45] Date of Patent: Jun. 23, 1987

[54] FIRE RESISTANT DUAL LAYER BIMETALLIC DOOR FRAME

[75] Inventor: Samuel R. Hall, Magnolia, Ark.

[73] Assignee: Alumax, Inc., San Mateo, Calif.

[21] Appl. No.: 812,735

[22] Filed: Dec. 23, 1985

[51] Int. Cl.[4] ..... E06B 1/04

[52] U.S. Cl. ..... 52/212; 52/211; 52/213; 49/504

[58] Field of Search ..... 52/204, 211, 212; 49/504, 505

[56] References Cited

U.S. PATENT DOCUMENTS

| | | | |
|---|---|---|---|
| 1,048,062 | 12/1912 | Fromhold | 52/595 |
| 3,131,792 | 5/1964 | Groneman et al. | 189/34 |
| 3,385,004 | 5/1968 | Oehler | 49/504 |
| 3,410,040 | 11/1968 | Biro et al. | 52/222 |
| 3,413,775 | 12/1968 | Katz . | |
| 3,676,966 | 7/1972 | Ragland | 49/504 |
| 3,955,330 | 5/1976 | Wendt | 52/204 |
| 3,998,024 | 12/1976 | Frandsen | 52/595 |
| 4,015,382 | 4/1977 | Noyes | 49/504 |
| 4,281,480 | 8/1981 | Wendt | 49/504 |
| 4,513,549 | 4/1985 | Wendt | 52/211 |
| 4,514,946 | 5/1985 | Sherwood | 52/211 |
| 4,530,189 | 7/1985 | Randall | 52/212 |

FOREIGN PATENT DOCUMENTS

| | | | |
|---|---|---|---|
| 2516158 | 5/1983 | France | 52/204 |

*Primary Examiner*—Henry E. Raduazo

*Attorney, Agent, or Firm*—Limbach, Limbach & Sutton

[57] ABSTRACT

A fire resistant dual layer, bimetallic door frame that comprises a fire resistant inner layer and an aesthetic outer layer. The inner layer, which is comprised of a first metallic material, has two parallel side portions and an upper horizontal portion. The outer layer, which is comprised of a second metallic material, has two parallel side portions and an upper horizontal portion, wherein each of the outer parallel side portions and the outer upper portion snugly receives the corresponding one of the inner parallel portions and the inner horizontal portion, whereby the bimetallic door frame is capable of resisting fire for at least 90 minutes.

8 Claims, 5 Drawing Figures

FIRE RESISTANT DUAL LAYER BIMETALLIC DOOR FRAME

DESCRIPTION

1. Technical Field

This invention relates to door frames, and more particularly, to a fire resistant dual layer, bimetallic door frame.

2. Background Art

Door frames and window frames are common in the art. To enhance the aesthetic features of such door frames or window frames, these frames are generally manufactured from aluminum or aluminum-related materials so as to give a high gloss luster. In addition, with the advent of portable or easily reconfigurable offices where the size or shape of the offices may be changed to conform to the need, lightweight and/or knock-down door and window frames are needed. Since those door and window frames must necessarily be light in weight so as to permit ease in movement or transportation, frames are therefore manufactured from lightweight materials such as aluminum. Aluminum door or window frames, however, are not as fire resistant as other materials. When fire resistant materials are used for door frames or window frames, e.g., stainless steel, these frames tend to be high in cost and heavy in weight. Having these drawbacks, steel door frames do not lend themselves for use in the reconfigurable office environment. Few products, heretofore, embody the twin attributes of fir resistance and attractiveness.

3. Disclosure of the Invention

An ideal door frame should not only be capable of presenting an aesthetic outlook but also be fire resistant. These twin requirements are necessary for door and window frames which are used in the modern office where both aesthetics and safety are paramount concerns.

It is a major object of the present invention to provide a fire resistant dual layer, bimetallic door frame that is not only aesthetic but also fire resistant.

In order to accomplish the above and still further objects, the present invention provides a fire resistant dual layer, bimetallic door frame that comprises a fire resistant inner layer and an aesthetic outer layer. The inner layer, which is comprised of a first metallic material, has two parallel side portions and an upper horizontal portion. The outer layer, which is comprised of a second metallic material, has two parallel side portions and an upper horizontal portion, wherein each of the outer parallel side portions and the outer upper portion snugly receives the corresponding one of the inner parallel portions and the inner horizontal portion, whereby the bimetallic door frame is capable of resisting fire for at least 90 minutes.

Other objects, features, and advantages of the present invention will appear from the following detailed description of the best mode of the preferred embodiment, taken together with the accompanying drawings.

BEST MODE FOR CARRYING OUT THE INVENTION

Figure 2:
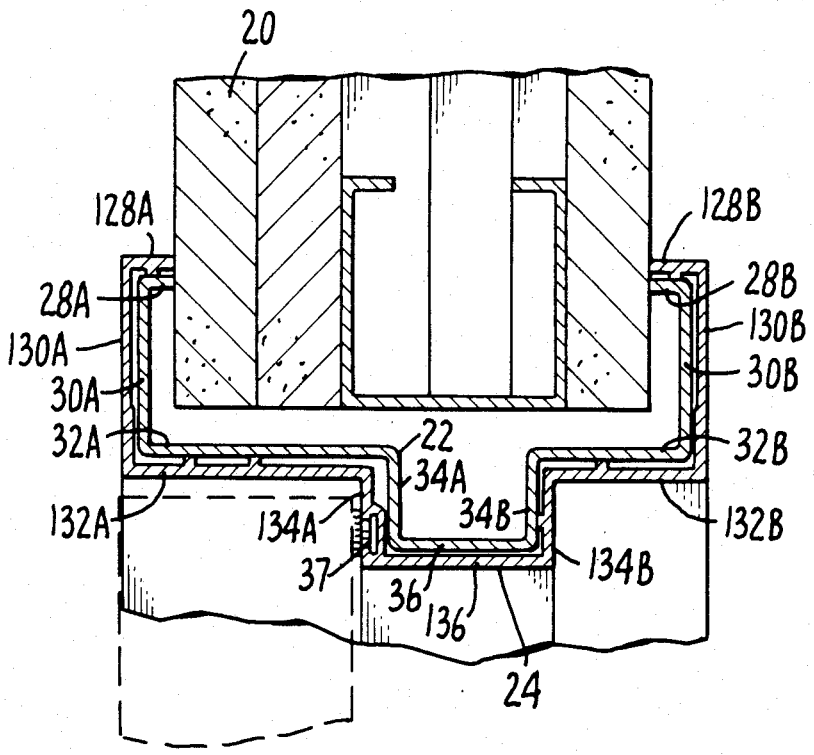
FIG. 2 is an enlarged, cross-section view of the door frame of FIG. 1, taken along line 2—2, with portions broken away.
Figure 1:
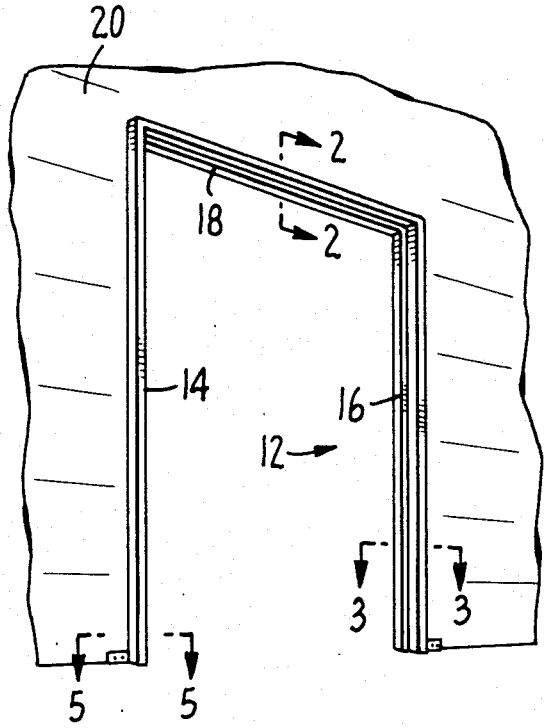
FIG. 1 is a perspective view of a fire resistant dual layer, bimetallic door frame of the present invention, when mounted to the wall of a building.

Referring to the Figures, there is shown a fire resistant dual layer, bimetallic door frame, designated 12. Door frame 12 comprises two parallel side portions 14 and 16, and an upper horizontal portion 18. The side portions are generally referred to as jambs and the horizontal portion is generally referred to as a header. More particularly, as especially illustrated in FIGS. 2 and 3, frame 12 is attached to a wall 20. Frame 12 comprises an inner layer 22 and an outer layer 24. Inner layer 22 and outer layer 24 are configured such that inner layer 22 is snugly fitted within outer layer 24 such that the two layers function as a unitary body.

In particular, as illustrated in FIG. 2, inner layer 22 of header portion 18 comprises opposite wall-engaging segments 28A and 28B, major parallel segments 30A and 30B, major horizontal segments 32A and 32B, minor parallel segments 34A and 34B, and minor horizontal segment 36. Outer layer 24, in turn, comprises counterparts to all of the segments of inner layer 22. Since the segments of the outer layer 24 are similar to their counterparts of inner layer 22, a numeral "1" is added to the numerals which designate the corresponding segments of inner layer 22. For example, the various segments of outer layer 24 are designated as wall-engaging segments 128A and 128B, major parallel segments 130A and 130B, major horizontal segments 132A and 132B, minor parallel segments 134A and 134B, and minor horizontal segment 136. In addition, frame 12 includes a door stop 37.

Figure 3:
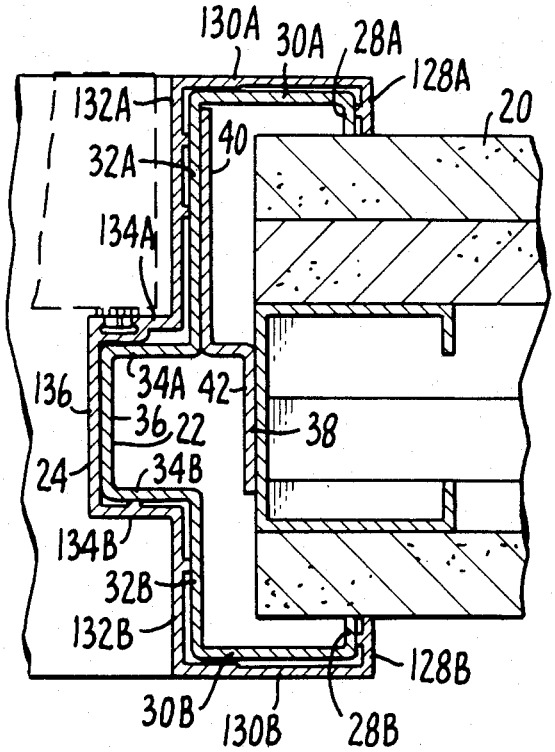
FIG. 3 is an enlarged, cross-section view of the door frame of FIG. 1, taken along line 3—3, with portions broken away.
Figure 4:
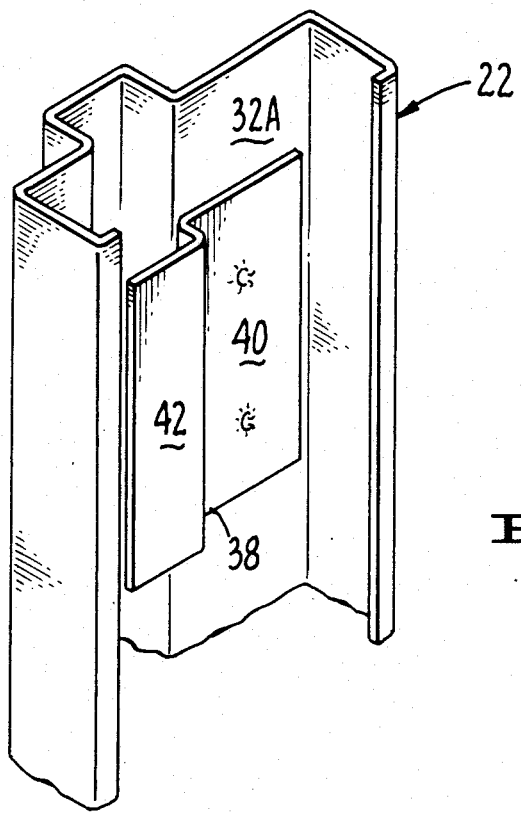
FIG. 4 is a perspective view of the outer layer of the door frame of FIG. 3.
Figure 5:
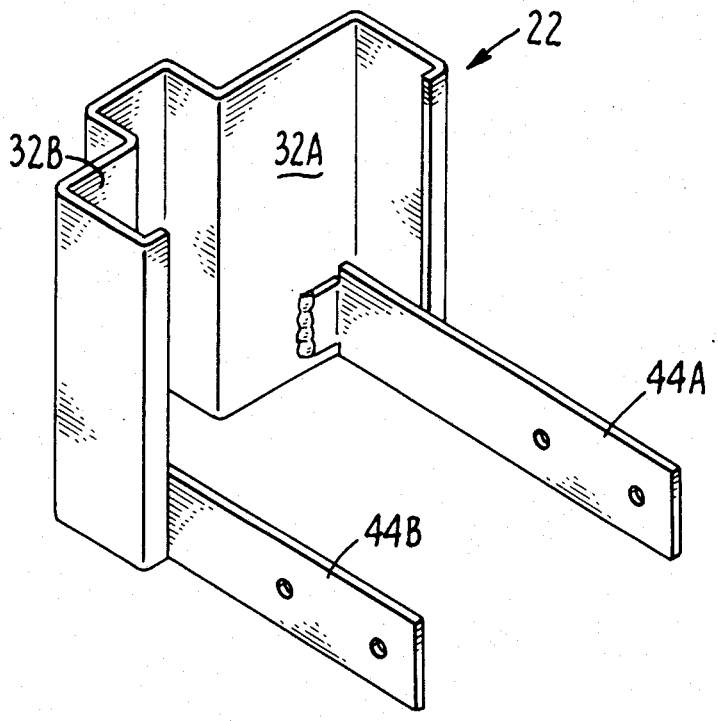
FIG. 5 is a perspective view of the outer layer of the door frame of FIG. 1, taken along line 5—5.

As best shown in FIG. 3, jamb 16 not only includes all elements which are present in header 18 but also a "Z" shaped spacer clip 38 for maintaining a desired distance between door frame 12 and wall 20. As best shown in FIG. 4, clip 38 includes two parallel legs 40 and 42. Leg 40 of clip 38 is welded to segment 32A of inner layer 22 and leg 42 abuts wall 20. Since spacer clip 38 is not present along the entire length of either jamb 14 or 16, jambs 14 and 16 each includes, at their lower extremeties, base anchor clips 44A and 44B, as best shown in FIG. 5. Base anchor clips 44A and 44B are welded to segments 32A and 32B, respectively, of inner layer 22. Anchor clips 44A and 44B are used to facilitate the fastening of inner layer 22 to wall 20.

In the preferred embodiment, inner layer 22 is manufactured from steel or stainless steel material, with a thickness of approximately 16 gauge. Spacer clip 38 has a thickness of approximately 16 gauge and each of anchor clips 44A and 44B has a thickness of approximately 18 guage. Outer layer 24 in turn is manufactured from aluminum, with a thickness of approximately 0.065 inch. The combination of these two materials permits door frame 12 to present an aesthetic feature as imparted by the aluminum outer layer 24. In addition, having a steel inner layer 22, door frame 12 is capable of resisting fire for a fire rating of approximately 90 minutes. The requirements for this fire rating are those specified in ASTM E-152 (American Society of Testing & Materials for "Fire Tests of Door Assemblies"); U.L.

10B (Underwriter's Laboratories for "Fire Tests of Door Assemblies"); NFPA 252 (National Fire Protection Association, Inc. for "Fire Tests of Door Assemblies 1984"); CSFM 43.7 (California State Fire Marshall, Title 19, Section 43.7 for "Standard for Fire Tests of Fire Door Assemblies SFM 43.7"); UBC 43.2 (Uniform Building Code, Section 43.2 for "Fire Tests of Door Assemblies"); and CAN4 S-104 (Canadian Standard 4-S104 for "Fire Tests of Door Assemblies"). A totally aluminum door frame in the prior art, albeit attractive, has a fire rating of only approximately 45 minutes. A totally steel door frame in the prior art, capable of having a fire rating of 90 minutes, is not only unattractive but also high in costs and heavy in weight. These two as well as other factors cause steel door frames to be not used in the reconfigurable office environment.

It will be apparent to those skilled in the art that various modifications may be made within the spirit of the invention and the scope of the appended claims. For example, although door frame 12 in the preferred embodiment is described as having three portions 14, 16 and 18, frame 12 may be manufactured as a unitary body. In addition, inner layer 22 and outer layer 24 may be manufactured from other material so long as the material of outer layer 24 is capable of presenting an aesthetic appearance and inner layer 22 is capable of enhancing the fire resistant capability of frame 12. Further, to prevent electrolysis between the two metals, e.g., steel and aluminum, a coating of primer paint is usually used as the interface between the metals.

I claim:

1. A fire resistant dual layer, bimetallic door frame for mounting into a wall, comprising a fire resistant inner layer having two parallel side portions and a horizontal portion, each having terminal ends, wherein each terminal end engages the wall; and an aesthetic outer layer having two parallel side portions and a horizontal portion, each having terminal ends, wherein each terminal end engages the wall, and furtherwherein each of the outer side portions and the outer horizontal portion is in close proximity to and in parallel with the corresponding one of the inner side portions and the inner horizontal portion, whereby the bimetallic door frame is capable of resisting fire for at least 90 minutes.

2. The fire resistant dual layer, bimetallic door frame as claimed in claim 1, wherein the inner layer comprises a first metallic material and the outer layer comprises a second metallic material.

3. The fire resistant dual layer, bimetallic door frame as claimed in claim 2, wherein the inner layer comprises a steel material and the outer layer comprises an aluminum material.

4. A fire resistant dual layer, bimetallic door frame for mounting into a wall, comprising a fire resistant inner layer having two parallel side portions and an upper horizontal portion, each of the parallel portions and the horizontal portion includes opposite wall-engaging segments at its terminal ends, major outer parallel segments, major outer horizontal segment, minor inner parallel segments, and a minor inner horizontal segment, wherein the terminal ends of each of the wall-engaging segments engage the wall; and an aesthetic outer layer having two parallel side portions and an upper horizontal portion, each of the parallel portions and the horizontal portion includes opposite wall-engaging segments at its terminal ends, major outer parallel segments, major outer horizontal segment, minor inner parallel segments, a and minor inner horizontal segment, wherein the terminal ends of each of the wall-engaging segments engages the wall, and furtherwherein each of the outer segments is in close proximity to and in parallel with the corresponding one of the inner side portions and the inner horizontal portion, whereby the bimetallic door frame is capable of resisting fire for at least 90 minutes.

5. The fire resistant dual layer, bimetallic door frame as claimed in claim 4, wherein the inner layer comprises a first metallic material and the outer layer comprises a second metallic material.

6. The fire resistant dual layer, bimetallic door frame as claimed in claim 5, wherein the inner layer comprises a steel material and the outer layer comprises an aluminum material.

7. The fire resistant dual layer, bimetallic door frame as claimed in claim 6, wherein the inner layer includes a spacer clip which engages the door frame and the wall for maintaining a desired distance between the door frame and the wall.

8. The fire resistant dual layer, bimetallic door frame as claimed in claims 6 or 7, wherein the inner layer further includes a pair of base anchor clips for mounting the inner layer to the wall.

* * * * *